US007962982B1

(12) United States Patent
Fellrath

(10) Patent No.: US 7,962,982 B1
(45) Date of Patent: Jun. 21, 2011

(54) OPERATING ROOM TABLE SAFETY STRAP

(76) Inventor: Sandra J. Fellrath, Champlin, MN (US)

( * ) Notice: Subject to any disclaimer, the term of this patent is extended or adjusted under 35 U.S.C. 154(b) by 0 days.

(21) Appl. No.: 12/798,435

(22) Filed: Apr. 5, 2010

(51) Int. Cl.
*A47C 27/03* (2006.01)

(52) U.S. Cl. ..... 5/621; 5/624

(58) Field of Classification Search ..... 5/621–624, 5/601–602, 658
See application file for complete search history.

(56) References Cited

U.S. PATENT DOCUMENTS 4,729,138 A * 3/1988 Heyman et al. ..... 5/658

* cited by examiner

*Primary Examiner* — Fredrick Conley
(74) *Attorney, Agent, or Firm* — Paul R. Martin

(57) ABSTRACT

A strap unit secures a patient to a table during surgery. The strap unit includes a pad which is interposed between the patient and a strap and the strap has grommets through which screws from clamps fit to securely hold the strap in place. The clamps can be placed anywhere on the operating table so the strap unit can be easily and expeditiously positioned in the most advantageous location. The unit further includes shims which are interposed between the strap and the table adjacent to the clamps to ensure proper and secure positioning of the unit with respect to the patient and operating room personnel. An over-center buckle closes the strap over the patient while allowing easy and secure placement of the strap on the patient.

4 Claims, 5 Drawing Sheets

OPERATING ROOM TABLE SAFETY STRAP

TECHNICAL FIELD OF THE INVENTION

Figure 1:
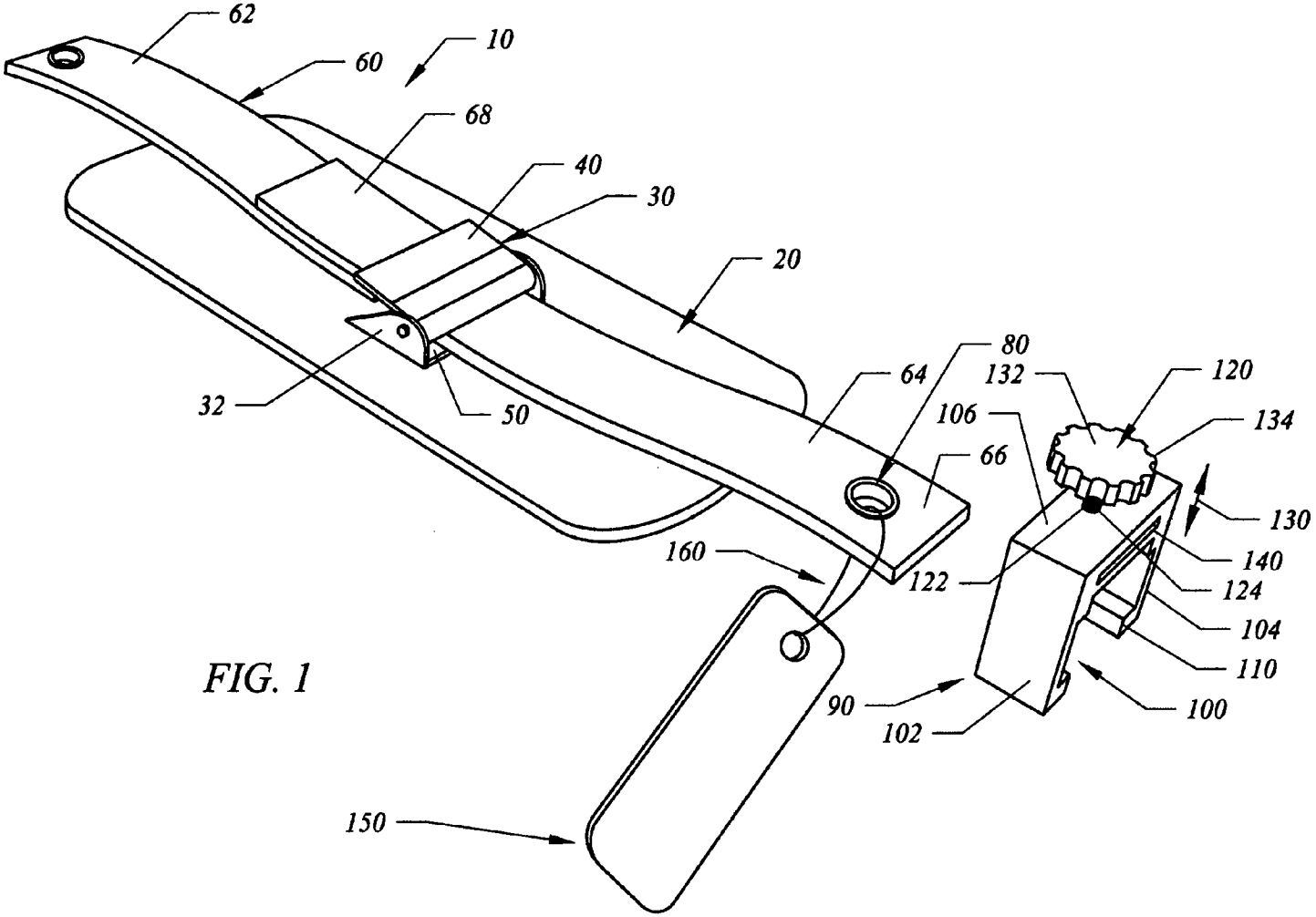

The present invention relates to the general art of surgery, and to the particular field of accessories used in surgery.

BACKGROUND OF THE INVENTION

There exists a large variety of patient tables for medical applications, each of which is generally functional within a narrow range of clinical procedures due to its singular table top design as well as its overall configuration. However, in all cases, the table consists of two or three basic elements. Generally there is a table attached to a supporting mechanism and a means to move the table in various directions, including up and down. The moving mechanism may be manually operable or may be power assisted in many directions other than merely up and down. The ability to move the patient, once they are on the table is of importance to clinicians, as well desirable for accessibility to many of today's modern medical diagnostic or therapeutic devices, such as x-ray equipment.

The final configuration of a particular patient support unit is arrived at after contemplation of the various modes and methods available for support and mobility for the types of surgical access required, as well as satisfying the many conflicting clinical requirements.

Various types of tables have been designed and developed over the years for the positioning of the human body for various types of examinations and manipulations. Such tables tilt about one or more axes and they include various portions or sections which move independently or in concert. They generally allow the human body, or various parts of the human body, to be appropriately positioned, as desired, for the type of manipulation or examination to be made by a user of the table.

The tables may be operated or positioned by hydraulic pressure, by spring pressure, by manual cranking of cranks and gears, or by physically positioning the table at a predetermined location by virtue of racks, slots, and the like, cooperating with physical stops to effect the positioning and maintaining of the table, or a part of the table, in a particular orientation.

Various designs for patient tables and the support structure have been discussed. In addition to the general configuration of the table and its support element, the ideal configuration permits the elevation and tilt of the patient in both the longitudinal plane (positive longitudinal tilt is known as Trendelenberg and negative longitudinal tilt is known as reverse Trendelenberg) and the lateral plane.

Additionally, tables may be designed to "float" the patient relative to the support mount. A floating table is one which moves in a predetermined plane on bearings mounted in a frame which is affixed to the support mount. While floating tables are ideally suited to radiology procedures, such configurations are not deemed acceptable for surgical procedures. Their unacceptability for surgical procedures is result of the patient's tethering to anesthesia equipment or other life support equipment.

Many surgical procedures require that a patient's body part, such as a limb, portion of a limb, extremity, organ or tissue be positioned in a number of different positions for the performance of a surgical procedure. It is desirable that the operating surgeon or surgical assistant be able to move the limb or other body part into other positions and configurations that may be required during the course of the surgical procedure. It is also desirable that any positioning apparatus that may be used to achieve such positions and configurations not obstruct the surgical site, and be able to avoid any obstacles that may exist around the surgical site, such as medical imaging systems, operating room lights, instrument trays, or other apparatus.

Various methods for positioning and supporting a patient's limb or body part are known in the prior art. One common method for positioning a body part is to have a sterile surgical assistant hold the body part in a desired position, and change the position when and as requested by the operating surgeon. This task is fatiguing for the surgical assistant, and this technique may not support the patient's body part in a sufficiently precise and rigid manner for the surgical procedure. Other typical methods for positioning a patient's limb are to rest the limb on a table for that purpose, to hang the limb over part of the operating room table, or to rest the limb on the lap of a seated operating surgeon. All of these techniques offer a very limited range of possible limb configurations, serve to restrict the movement of the surgeon, and result in reduced precision and rigidity of support.

In addition to the methods for positioning illustrated above, apparatus for supporting and positioning body parts exists in the art. One common supporting means consists of slings attached to the patient's limb, ropes and occasionally weight, which are hung over or tied to operating room light fixtures, intravenous fluid support stands, or other operating room fixtures, in order to suspend the limb. These types of supporting means are difficult to set up and take down, clumsy to adjust, and often obstruct the surgical site. Furthermore, adjusting such apparatus to achieve a new position may require the assistance of a non-sterile person, in that operating room fixtures and support stands that may require re-positioning are not considered sterile, hence cannot be touched by a surgeon. This may preclude optimal positioning of the limb or body part, as the surgeon may no longer have direct control over the final position of the limb or body part.

However, these known methods and structures all have various drawbacks, such as being cumbersome and difficult to install, use and adjust. Furthermore, many of these devices and methods are difficult, if not impossible, to adapt to various locations on the operating table. Still further, some of the known devices interfere with sight lines as well as access to the patient. Thus, these known devices have not been readily accepted by health care professionals.

Therefore, there is a need for a means and method for securing patient or a patient's body part securely to an operating table in an efficient yet secure manner and in a location that is most efficient for the procedure.

SUMMARY OF THE INVENTION

The above-discussed disadvantages of the prior art are overcome by a safety strap that is placed over a patient on an operating table and which is attached to the table and held securely in place by means of two brackets that are attached to rails on the table. The strap has a single buckle which is used to tighten the strap against the patient. A shim or a long screw is used to ensure that the bracket is securely held in place on the table rail. The shim can be attached to the belt by a wire.

Using the safety strap unit embodying the present invention will permit securing the strap exactly where it is most effective and the belt will not loosen under sterile drapes. The belt can be securely attached to the table at any location where it will be most effective.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 1 is a perspective view of an O.R. Table Safety Strap embodying the principles of a first form of the present invention.

Figure 2:
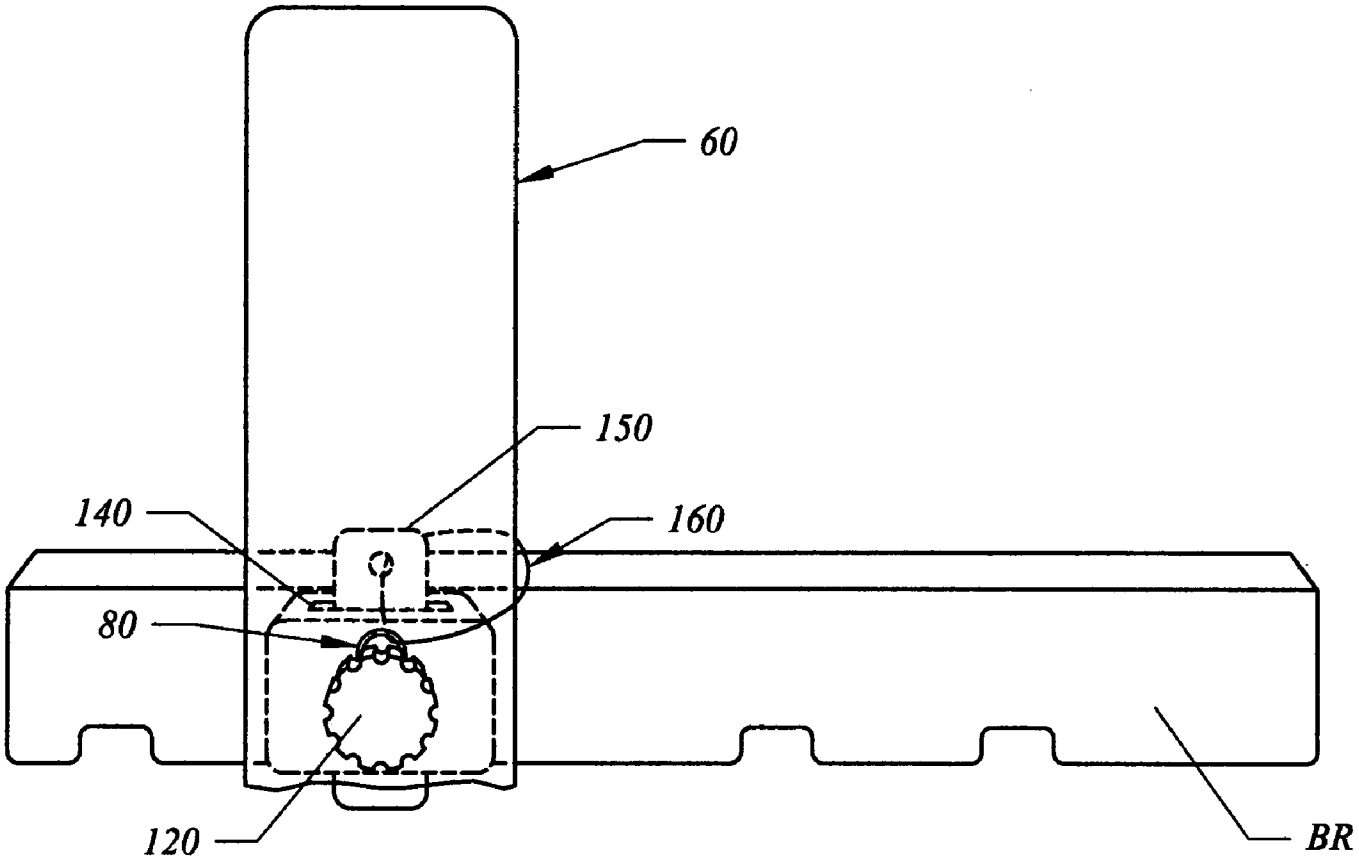

FIG. 2 shows the O.R. Table Safety Strap of FIG. 1 attached to a bed rail of an O.R. Table.

Figure 3:
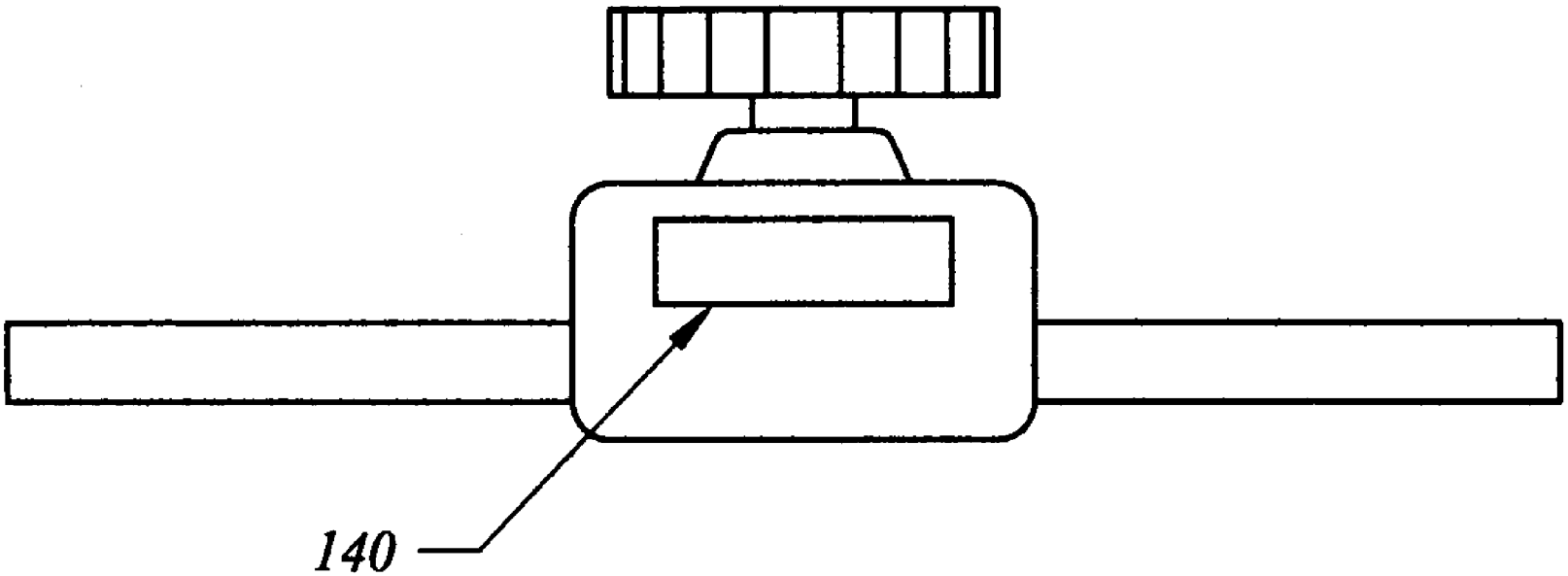

FIG. 3 shows a bracket used to attache the Safety Strap to the rail of an O.R. Table.

Figure 4:
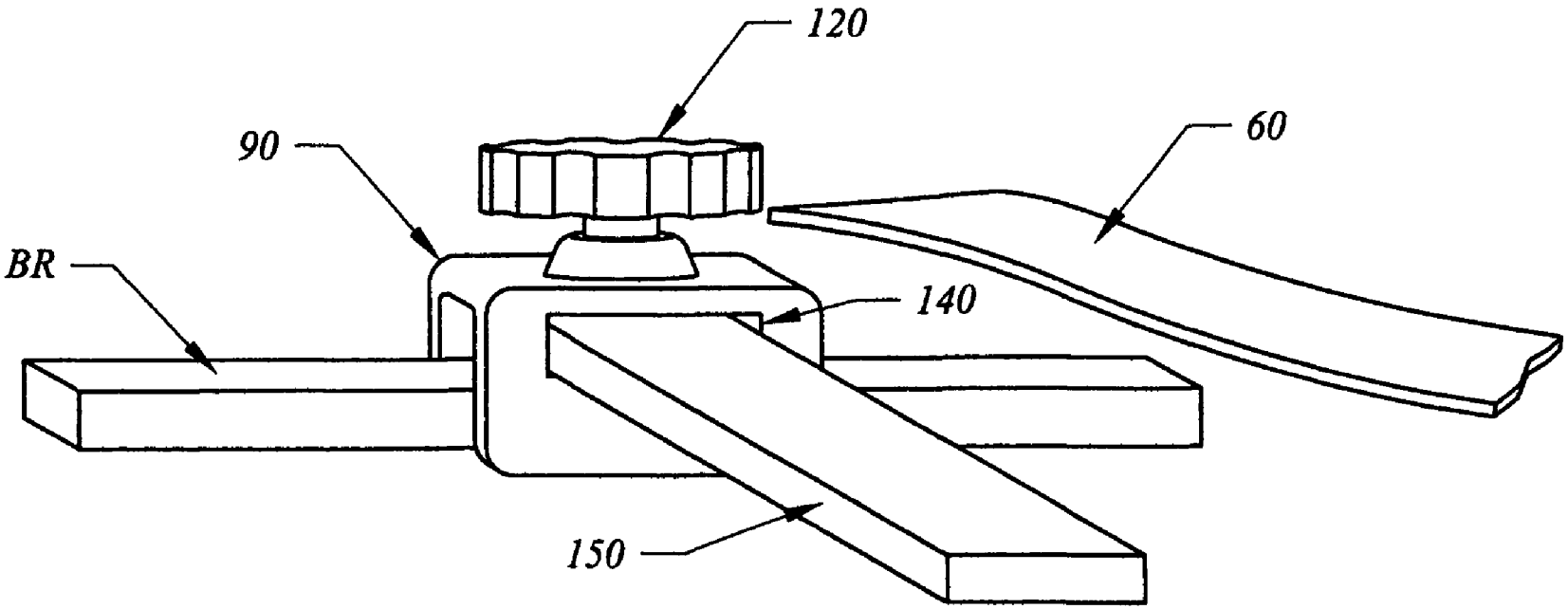

FIG. 4 shows the O.R. Table Safety Strap of FIG. 1 attached to a bed rail of an O.R. Table.

Figure 5:
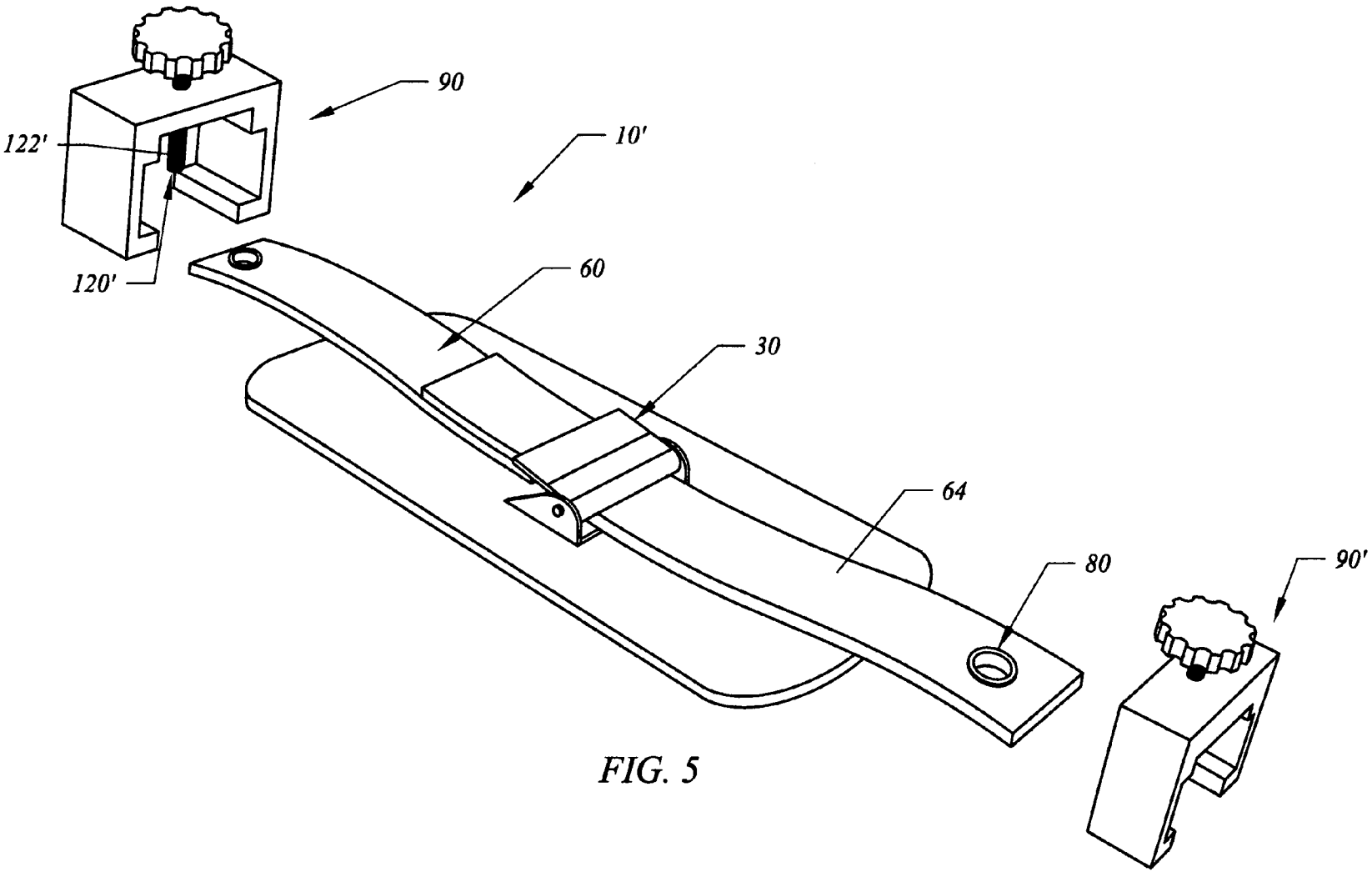

FIG. 5 is a perspective view of an O.R. Table Safety Strap embodying the principles of a second form of the present invention.

DETAILED DESCRIPTION OF THE INVENTION

Referring to FIGS. 1-4, it can be understood that a first form of the present invention is embodied in a safety strap unit 10 that is used to secure a patient to an operating room table in the position and location that is most efficient for both the patient and the health care personnel and which, once secured, is not likely to loosen.

Strap unit 10 includes a pad element 20 on which one section 62 of the belt 60 and a single buckle element 30 is mounted. Buckle unit 30 includes a base portion 32 mounted on the pad and a hand-operated latch portion 40 which is pivotally attached to the base portion to define a belt accommodating opening 50 and to open and close that opening as the latch portion is moved in the manner of an airplane seat belt buckle.

A belt 60 includes two sections, 62 and 64, each of which has a first end 66. Belt section 64 has a second end 68 which is threaded through the opening defined in the buckle element to close the belt and which is removed from the opening to open the belt. The belt is shown in the closed condition in FIG. 1. A grommet 80 is located on first end 66 of each belt section and will be located adjacent to a rail BR (see FIGS. 2-4) of the bed when the belt is in use as will be understood from the teaching of this disclosure. A bracket 90 attaches the first end 66 of each belt section to the bed rail and includes a U-shaped body 100 having legs 102 and 104 each attached at one end to a bight section 106 and each having a ledge 110 on the other end for securely engaging the bed rail to connect the belt to the bed in a selected position. Bracket 90 further includes a set screw 120 threadably attached to the bight section by means of an externally threaded body 122 threadably received in an internally threaded opening 124 defined through the bight section to move toward and away from the ends of the legs as indicated in FIG. 1 by double-headed arrow 130. Body 122 has a head 132 on one end thereof and the head is used to turn the screw to advance or retract that screw in directions 130. Knurling 134 is located on an external surface of the head so the screw can be securely placed as needed.

A slot 140 is defined through the bight section in position to be interposed between the screw and the bed rail. A shim 150 is accommodated in slot 40 and is interposed between the screw and the bed rail to be tightened down against the bed rail when the screw is tightened to ensure that the bracket is securely held against the bed rail by the screw when the screw is tightened down. The shim can be attached to the belt section by means of a wire 160. Each end of the belt has a shim associated therewith and the showing of only one shim in FIG. 1 is not intended to be limiting. The shim secures the strap to the bed at any location because, with it placed in the slot, the screw tightens down to the shim and that creates a secure bracket that will not slide on the bed rail. The strap fits between the part of the bracket that is on the outside portion closest to where the screw turns into the bracket. If one removes the screw completely out of the bracket, slides the strap onto the screw through the grommet, and places the screw back in the bracket then tights it down, the strap will be secured by the screw to the bracket.

In use of belt unit 10, the brackets are attached to the rails on each side of the Operating Room bed, the screws are removed from the brackets, the strap sections are then attached to the brackets and the shims are placed in the brackets. One bracket is on each side of the bed. The health care personnel then slides the brackets along the bed rail into the selected position and the screws of the brackets are then tightened through the grommets on the strap sections and against the shims to force the shims into secure frictional engagement with the bed rails. The patient then lies down on the table, the health care personnel positions the section of the belt that includes the pad and the buckle over the patient, grabs the other section of the belt unit and brings it together at the belt buckle element and the buckle element is adjusted to properly accommodate the patient and is then closed to secure the patient to the table.

An alternative form of the belt unit is shown in FIG. 5 as unit 10'. Unit 10' is identical to unit 10 with the exception that unit 10' has a bracket 90' with a set screw 120' that has a threaded body 122' which is long enough to securely frictionally engage the bed rail without requiring a shim. Bracket 90' does not need a slot similar to slot 140 in bracket 90 since no shim is required for bracket 90'. Otherwise unit 10' is identical to unit 10 and is operated and functions in the same manner as described above for unit 10.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A safety strap unit for attaching a patient to an operating table consisting of:

A) two bed rails on an operating room table;

B) two bracket assemblies, each bracket assembly being mounted on an associated bed rail when in use, each bracket including a U-shaped body having two legs attached to a bight section and a set screw threadably mounted on the bight section;

C) a pad which engages a patient when in use;

D) a single buckle unit mounted on the pad;

E) two strap sections, each strap section having a first end which is attached to an associated bracket assembly and a second end which is connected to the buckle unit when in use securing a patient to the operating room table, each strap section further including a grommet located adjacent to the first end thereof and through which the screw of the associated bracket assembly extends to attaché the strap to the bed rail via the associated bracket assembly; and F) a shim element associated with the first end of each strap section and which is interposed between the set screw and the bed rail when in use.

2. A safety strap unit for attaching a patient to an operating room table comprising:

A) a bed rail on an operating room table;

B) two bracket assemblies, each bracket assembly being mounted on the bed rail when in use, each bracket including a U-shaped body having two legs attached to a bight section and a set screw threadably mounted on the bight section;

C) a pad which engages a patient when in use;

D) a buckle unit mounted on the pad;

E) two strap sections, each having a first end which is attached to an associated bracket assembly and a second end which is connected to the buckle unit when in use securing a patient to the operating room table, each strap unit further including a grommet located adjacent to the first end thereof and through which the screw of the bracket assembly extends to attach the strap to the bed rail via the bracket and the bed rail; and F) a shim element associated with the first end of each strap section and which is interposed between the set screw and the bed rail when in use.

3. The safety strap unit defined in claim 1 further including a wire element attaching each shim element to the strap section associated therewith.

4. The safety strap unit defined in claim 1 wherein each bracket assembly has a slot defined in the bight section thereof and which accommodates a shim element when in use.

* * * * *